US011939790B2

(12) United States Patent
MacKay

(10) Patent No.: US 11,939,790 B2
(45) Date of Patent: Mar. 26, 2024

(54) SWIM SPA COVER

(71) Applicant: HYDROPOOL INC., Mississauga (CA)

(72) Inventor: Andrew MacKay, Barrie (CA)

(73) Assignee: HYDROPOOL INC., Mississauga (CA)

( * ) Notice: Subject to any disclaimer, the term of this patent is extended or adjusted under 35 U.S.C. 154(b) by 55 days.

(21) Appl. No.: 17/780,105

(22) PCT Filed: Nov. 26, 2020

(86) PCT No.: PCT/CA2020/051617
§ 371 (c)(1),
(2) Date: May 26, 2022

(87) PCT Pub. No.: WO2021/102575
PCT Pub. Date: Jun. 3, 2021

(65) Prior Publication Data

US 2023/0012439 A1 Jan. 12, 2023

Related U.S. Application Data

(60) Provisional application No. 62/940,464, filed on Nov. 26, 2019.

(51) Int. Cl.
*E04H 4/08* (2006.01)

(52) U.S. Cl.
CPC ..... *E04H 4/08* (2013.01)

(58) Field of Classification Search
CPC .... E04H 4/06; E04H 4/08; E04H 4/10; E04H 4/101–108; A47K 3/001
USPC ..... 126/561–568
See application file for complete search history.

(56) References Cited

U.S. PATENT DOCUMENTS 3,072,920 A * 1/1963 Yellott ..... F24S 10/17 160/DIG. 7
4,366,806 A * 1/1983 Acker ..... F24S 10/17 126/565
4,606,083 A 8/1986 Kingston
4,953,239 A 9/1990 Gadsby
(Continued)

FOREIGN PATENT DOCUMENTS

GB 2144035 A 2/1985

OTHER PUBLICATIONS

Extended European Search Report dated Dec. 7, 2023 issued in EP 20894198.9.

*Primary Examiner* — Erin Deery
(74) *Attorney, Agent, or Firm* — Bennett Jones LLP; Lorelei G. Graham

(57) ABSTRACT

A swim spa cover having a first bottom protection layer and may be positioned over the body of water. The first bottom protection layer includes a first radiant barrier. The swim spa cover includes a series of support rods that are adapted to engage across the first bottom protection layer. The swim spa cover includes a second rounded support layer positioned on top of the support rods. A third waterproof top layer is adapted to engage across the second rounded support layer. A first air gap is created between the body of water and first bottom protection layer. A second air gap is created between the series of support rods, the first bottom protection layer and the second rounded support layer. A third air gap is created within the second rounded support.

9 Claims, 9 Drawing Sheets

(56) References Cited

U.S. PATENT DOCUMENTS

| | | | | |
|---|---|---|---|---|
| 5,373,590 | A | 12/1994 | Svae | |
| 5,619,759 | A | 4/1997 | Hansen et al. | |
| 6,112,340 | A | 9/2000 | Ziebert et al. | |
| 8,683,621 | B1 * | 4/2014 | Gustason | E04H 4/10 4/498 |
| 9,725,919 | B1 | 8/2017 | Vanderpool et al. | |
| 2018/0328057 | A1 | 11/2018 | Coelho | |

* cited by examiner

SWIM SPA COVER

TECHNICAL FIELD

This disclosure generally relate to the field the covers and in particular covers for swim spas.

BACKGROUND OF THE ART

Swim spas, hot tubs and swimming pools are traditionally situated outside requiring a cover to ensure that debris does not enter the body of water and more importantly, to insulate and maintain the temperature of the body of water. This is particularly true for swim spas and hot tubs which are often used all year-round. The size of body of water that requires covering will dictate the size of cover. These covers are often very heavy and difficult to manoeuver for an individual to handle on their own. In most cases, the placement and removal of these covers takes multiple people. Additional mechanisms are often used to try and manage the movement of the swim spa cover. These mechanisms are often cumbersome and detract from the overall aesthetic of the swim spa.

Keeping the heat within the body of water is an additional concern that most swim spa covers try to address. These covers typically are positioned directly on the body of water and are awkward to try and remove as they are wet and are difficult to handle.

SUMMARY

In accordance with one aspect, there is provided a swim spa cover that may include a first bottom protection layer and may be positioned over a body of water. The first bottom protection layer may have a first radiant barrier. The swim spa cover may also include a series of support rods that are adapted to engage across the first bottom protection layer. The swim spa cover may further include a second rounded support layer positioned on top of the support rods. A third waterproof top layer may be adapted to engage across the second rounded support layer.

A first air gap may created between the body of water and first bottom protection layer. A second air gap may be created between the series of support rods, the first bottom protection layer and the second rounded support layer. A third air gap may be created within the second rounded support layer.

In accordance with another aspect, there is provided that the first bottom protection layer may be further defined to include the first radiant barrier positioned between two poly foam substrates. The first radiant barrier may be defined as aluminum foil reflective material.

In accordance with another aspect, there is provided that the second rounded support layer further includes a series of rounded supports positioned in between at least two second radiant barriers. The two second radiant barriers may each be further defined as having a foam layer positioned between two layers of aluminum foil reflective material.

In accordance with another aspect, there is provided that the third waterproof top layer extends beyond the second rounded support layer creating a waterproof overhang portion.

Many further features and combinations thereof concerning the present improvements will appear to those skilled in the art following a reading of the instant disclosure.

Figure 1:
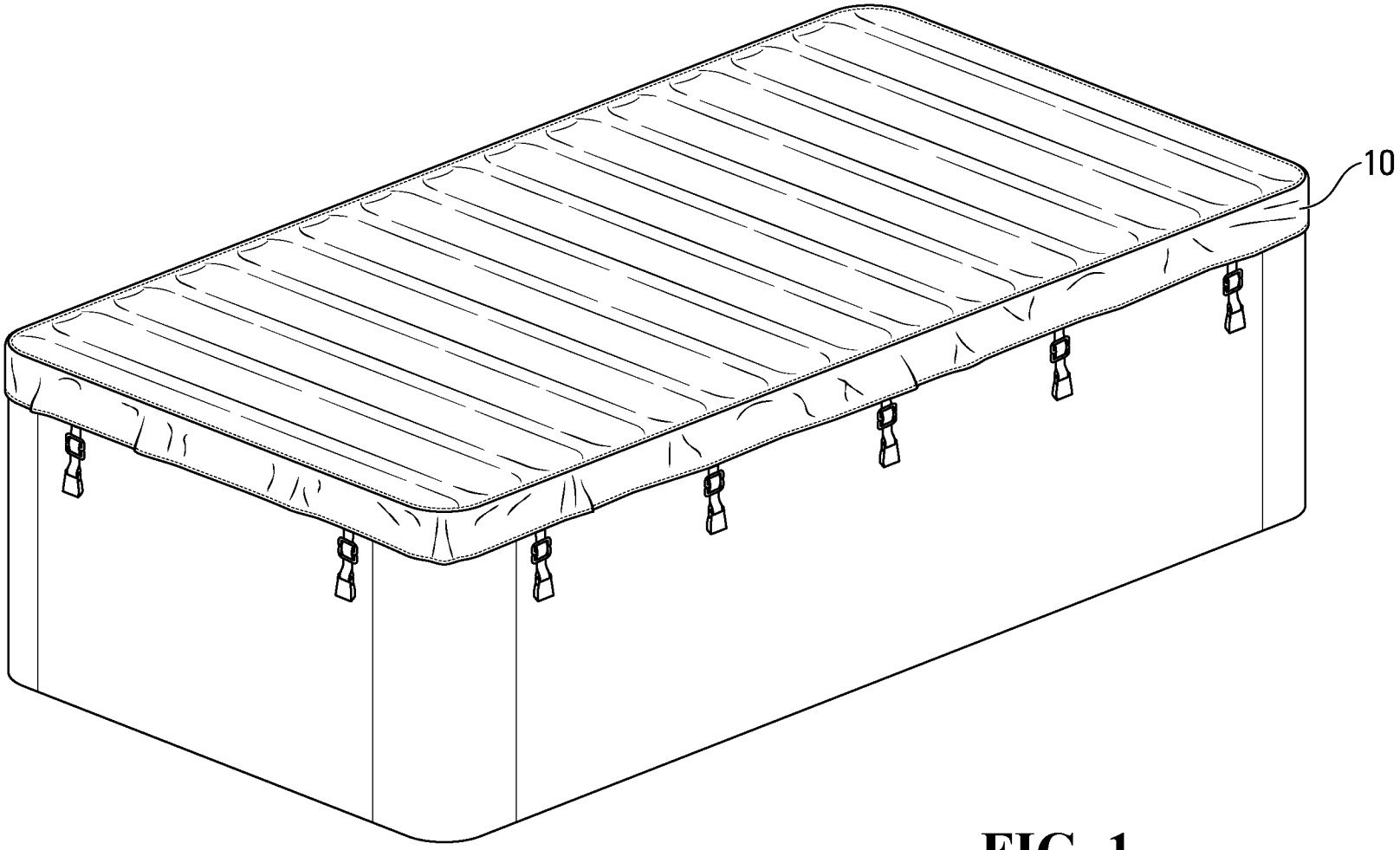
FIG. 1 is a top perspective view of an example of the swim spa cover.

In the drawings, preferred embodiments of the invention are illustrated by way of example. It is to be expressly understood that the description and drawings are only for the purpose of illustration and as an aid to understanding, and are not intended as a definition of the limits of the invention.

DETAILED DESCRIPTION

Figure 2:
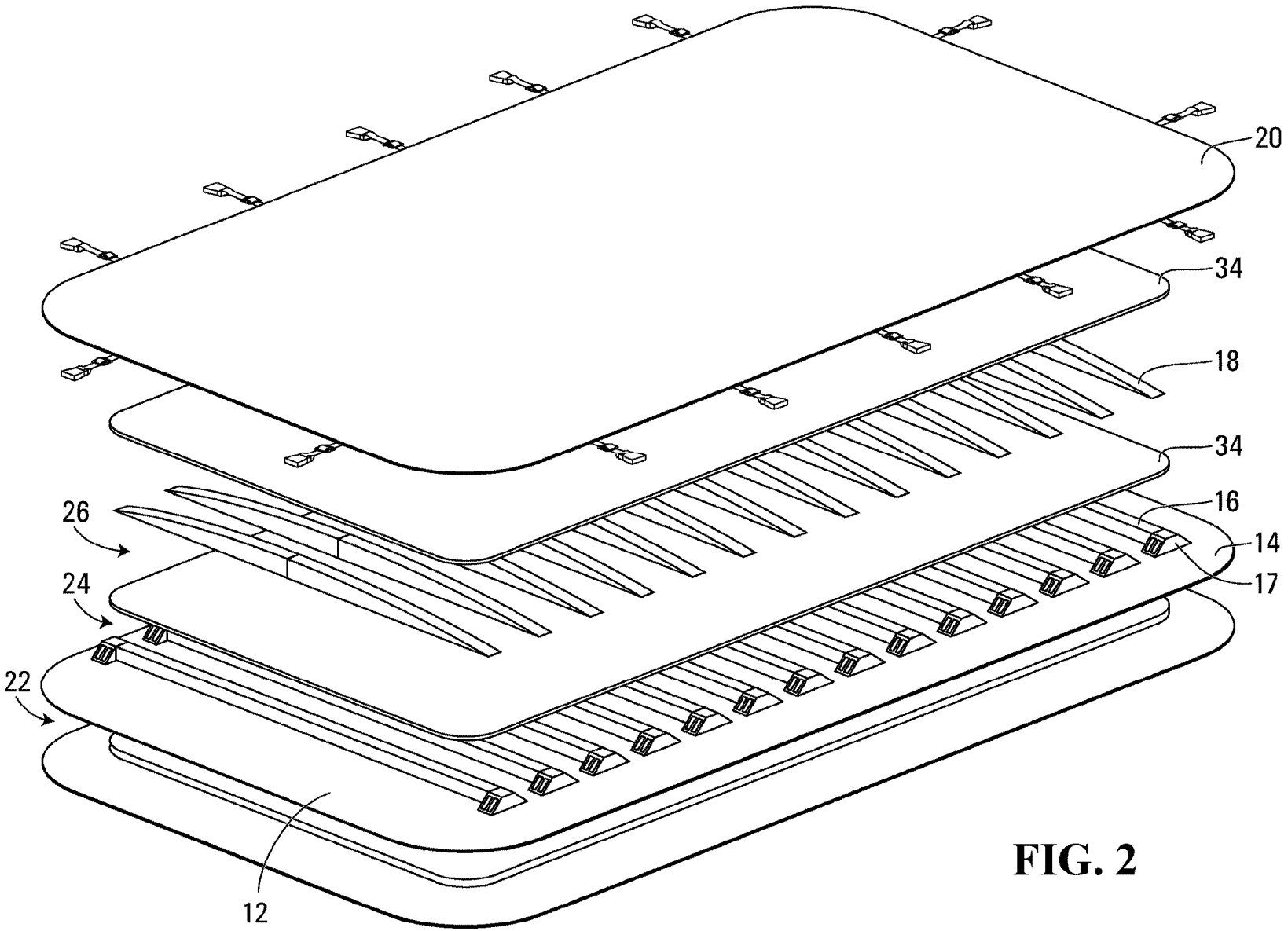
FIG. 2 is a exploded perspective view of an example of the swim spa cover.
Figure 3:
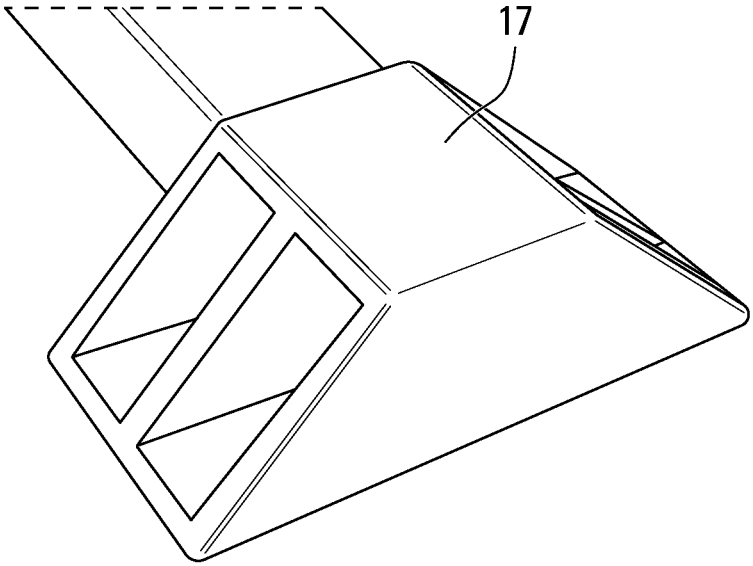
FIG. 3 is a partial perspective view of a positioning member of the swim spa cover.
Figure 4:
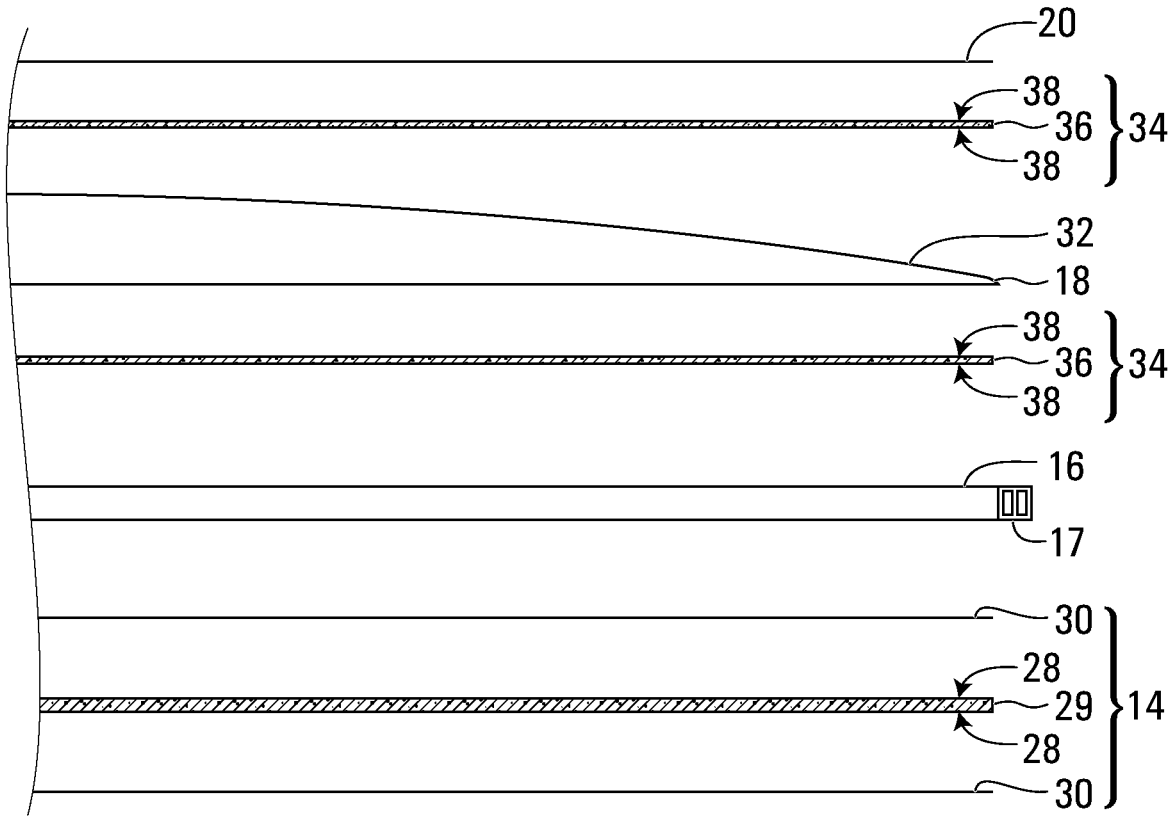
FIG. 4 is a schematic view of the various layers of the swim spa cover.
Figure 5:
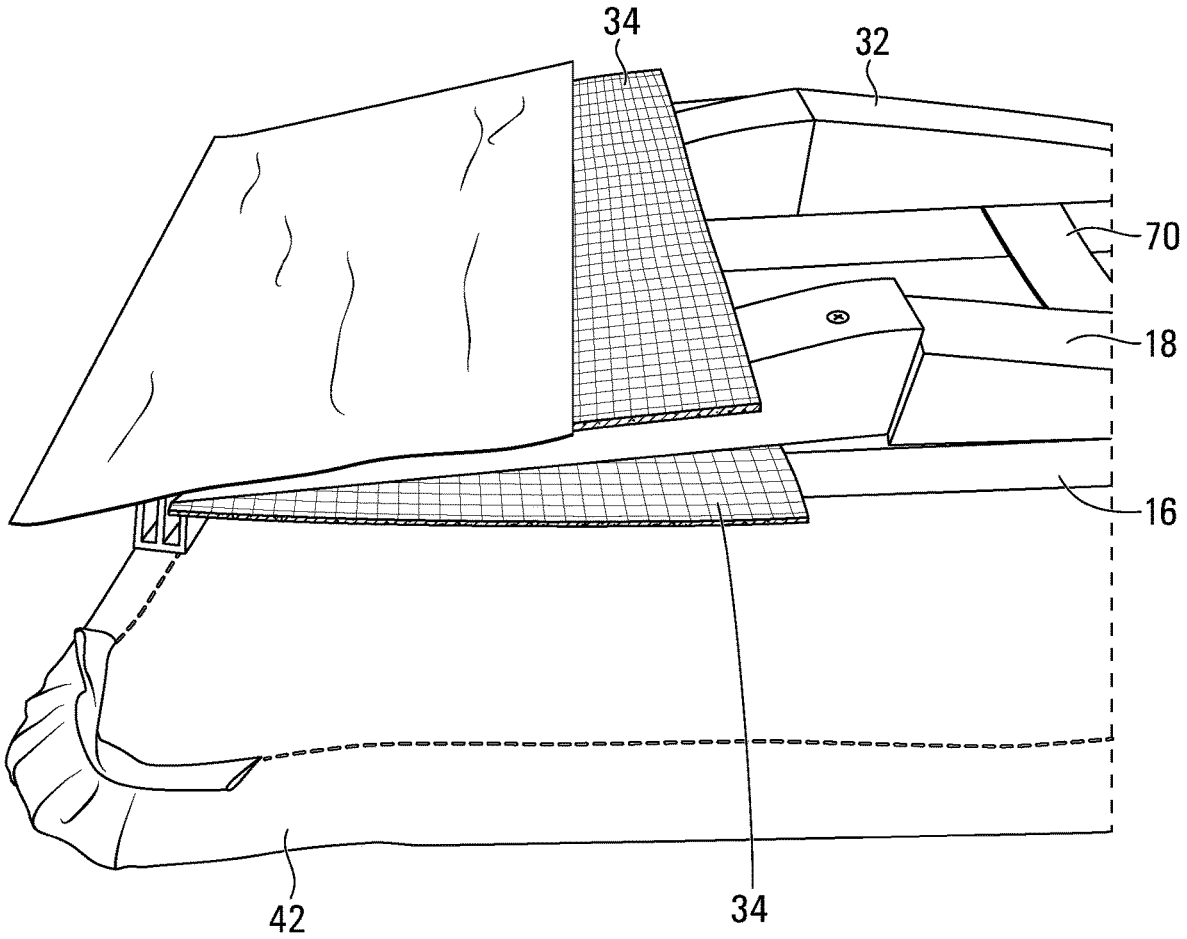
FIG. 5 is a partial cut-away view of the swim spa cover.
Figure 6:
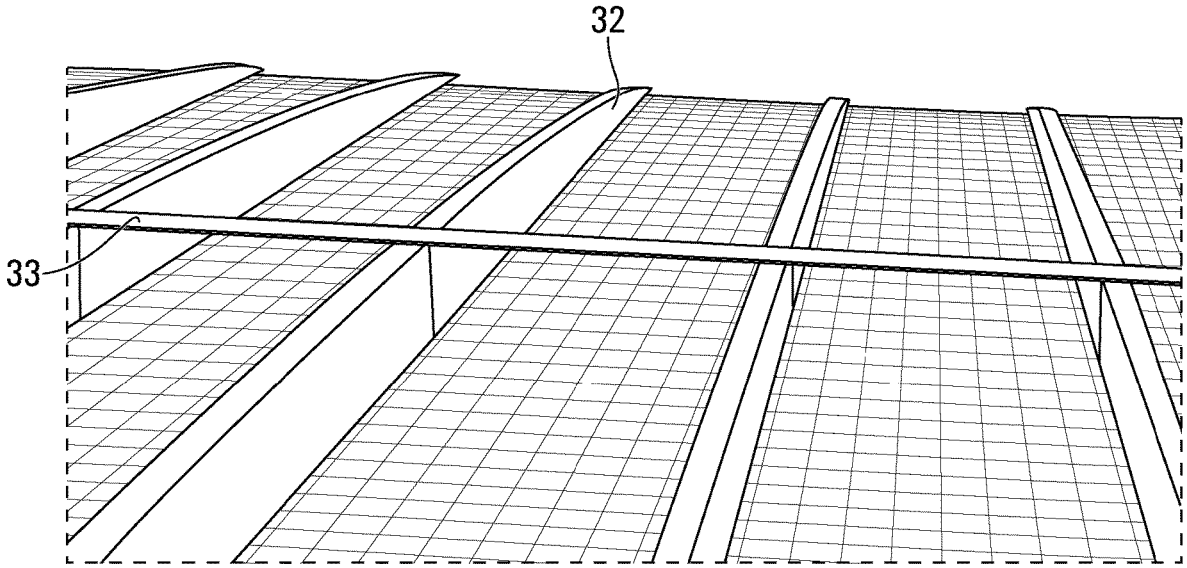
FIG. 6 is a partial perspective view of a support strap positioned across and perpendicular to all the series of rounded supports of the swim spa cover.
Figure 7:
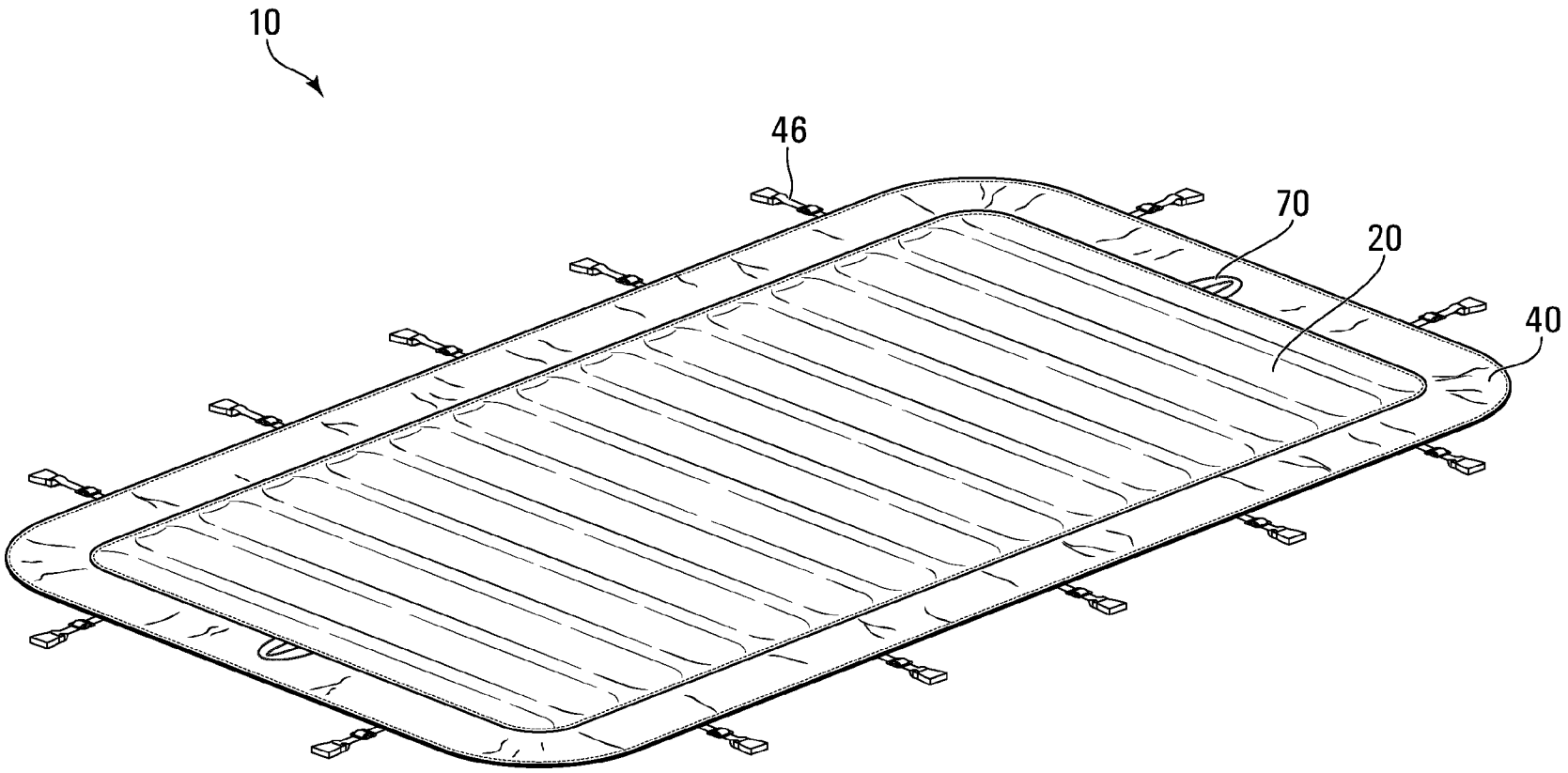
FIG. 7 is a top perspective view of the swim spa cover.
Figure 8:
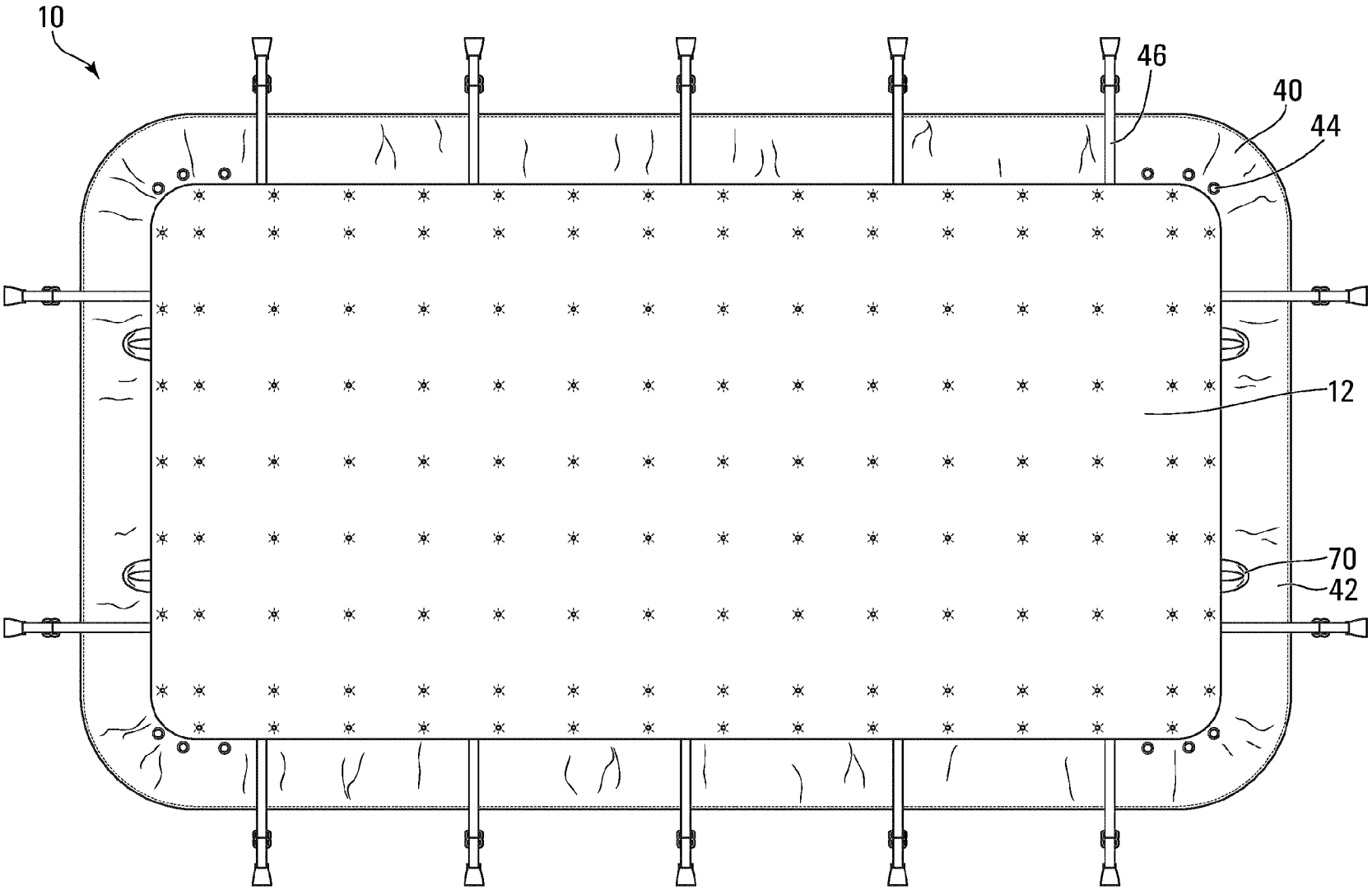
FIG. 8 is a bottom plan view of the swim spa cover.
Figure 9:
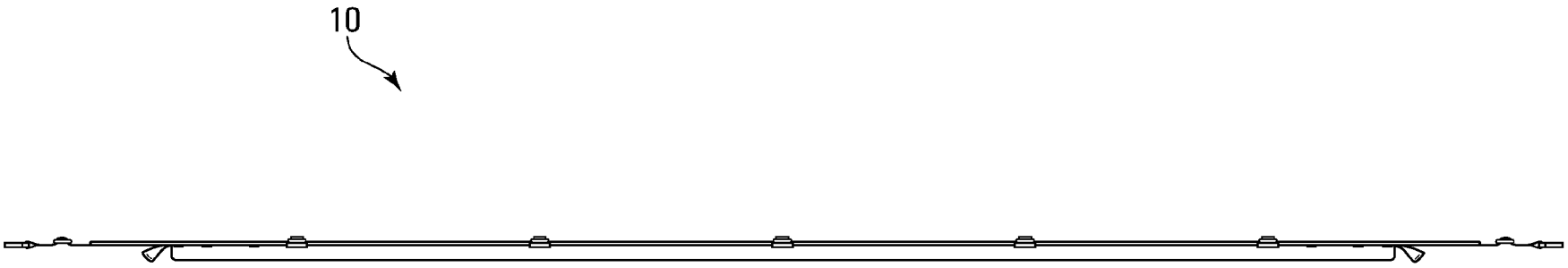
FIG. 9 is a front elevation view of the swim spa cover.

Referring to FIGS. 1 to 9, there is illustrated, a swim spa cover in accordance with the preferred embodiment of the present invention. The swim spa cover 10 may be positioned over a body of water and includes a first bottom protection layer 12. The first bottom protection layer 12 may have a first radiant barrier 14. The swim spa cover 10 may also include a series of support rods 16 adapted to engage across the first bottom protection layer 12.

The swim spa cover 10 further includes a second rounded support layer 18 positioned on top of the support rods 16. A third waterproof top layer 20 is adapted to engage across the second rounded support layer 18. A first air gap 22 is created between the body of water and first bottom protection layer 12. A second air gap 24 is created between the series of support rods 16, the first bottom protection layer and the second rounded support layer 18. A third air gap 26 is created within the second rounded support 18. During engagement, the swim spa cover 10 lies flat over the body of water. When the swim spa cover 10 is stored, the swim spa cover 10 is in a rolled up position.

The first bottom protection layer 12 typically is of a length and a width so as to cover the body of water. The first bottom protection layer 12 may be further defined to include the first radiant barrier 14 positioned between two poly foam substrates 30. The first radiant barrier 14 may be defined to include an aluminum foil reflective material 28. The two poly foam substrates 30 may be made from rubberized foam, for example that is positioned on either side of the aluminum foil reflective material 28 so as to encourage heat insulation and retention. The aluminum foil reflective material 28 itself may be further defined as a layer of rubberized foam 29 (12 mm) having aluminum foil on either side of the rubberized foam layer.

The first bottom protection layer 12 does not engage the surface of the body of water, but sits slightly above the surface of the body of water. As such the first air gap 22 is created between the surface of the body of water and the first radiant barrier 14 and more specifically the poly foam substrates 30 and aluminum foil reflective material 28 combination.

The series of support rods 16 are typically engaged across the width of the first bottom protection layer 12 and are positioned down the length of the first bottom protection layer 12. The series of support rods 16 are typically positioned equi-distance from each other. The series of support rods 16 are typically made from a flexible material such as a plastic composite. The series of support rods 16 are adhered directly to the first bottom protection layer 12. The series of support rods 16 may further include a positioning member 17 at each end of the support rod 16. The positioning member 17 may be weighted foot that helps to ensure that the support rods 16 remain in a upright position.

The second rounded support layer 18 further includes a series of rounded supports 32 positioned in between at least two second radiant barriers 34. The two second radiant barriers 34 may each be further defined as having a foam layer 36 positioned between two layers of aluminum foil reflective material 38. Each layer of the second radiant barrier 34 provides the flexibility and support from the foam layer 36, as well as the radiant and insulation properties from the aluminum foil reflective material 38. The foam layer 36 may be made from 5 mm rubberized foam for example. Each second radiant barrier 34 is positioned on either side of the rounded supports 32. The series of rounded supports 32 may be constructed from foam. A support strap 33 may be positioned across and perpendicular to all the series of rounded supports 32 and more specifically positioned perpendicularly at a mid-point across the series of rounded supports 32. The support strap 33 encourages the uniform movement of the swim spa cover 10.

The series of rounded supports 32 are positioned directly on top of each of the support rods 16. As such, each support rod 16 has a rounded support 32 positioned on top of it, with a layer of the second radiant barrier 34 positioned in between. Moreover the rounded supports 32 provide additional support and strength to the overall structure of the swim spa cover 10. This additional strength helps ensure that any additional weight that lands on top of the swim spa cover 10, does not cause the swim spa cover 10 to cave into the body of water. As such, the combination of the series of rounded supports 32 on top of the support rods 16 improves the safety aspects of the swim spa cover 10. The addition of the positioning members 17 on each end of the support rods 16 also ensures that the support rods 16 and the series of rounded supports 32 remain upright, resist rolling to either side and provide additional support.

The positioning of the rounded supports 32 also helps to deflect any water or pooling of water on the top surface of the swim spa cover 10. Furthermore the combination of the rounded supports 32 and the support rods 16 provide shape to the swim spa cover 10 and prevent sagging and deformity of the swim spa cover 10. Finally this combination ensures the correct positioning of the support rods 16 when the swim spa cover 10 is being rolled up to a storage position. More specifically, the positioning of the rounded supports 32 on top of each support rod 16 prevents the support rods 16 from rolling over to a side position when the swim spa cover 10 is being rolled up.

The second air gap 24 is created between the series of support rods 16, the first bottom protection layer and the second rounded support layer 18, or more specifically the first layer of the second radiant barrier 34. The additional or second layer of the second radiant barrier 34 is positioned on top of the rounded supports 32. The third air gap 26 is therefore created within the second rounded support layer 18 between the two second radiant barriers 34 and the rounded supports 32. The creation of the first air gap 22, the second air gap 24, and the third air gap 26 allows for a triple thermal design for the swim spa cover 10. Each radiant barrier 14 and 34 aids in trapping and containing the heat from the body of water, thereby improving the insulated properties of the swim spa cover 10.

The third waterproof top layer 20 is adapted to engage across the second rounded support layer 18 and more specifically the second layer of the second radiant barrier 34 that is positioned over the top of the rounded supports 32. The third waterproof top layer 20 may be defined as a flexible waterproof fabric that is adhered directly to the second radiant barrier 34. The third waterproof top layer 20 may extend beyond the second rounded support layer 18 thereby creating a waterproof overhang portion 40. The waterproof overhang portion 40 may be further defined as a walled cuff 42. The walled cuff 42 may include additional insulation on the inside perimeter of the walled cuff 42, such as 5 mm of foam to improve heat retention.

The third waterproof top layer 20 may further include a series of air vents 44 or holes positioned close to the waterproof overhang portion 40. The air vents 44 may be reinforced with the grommet. The series of air vents 44 assist when the swim spa cover 10 is being rolled up. Specifically when the user wishes to remove the swim spa cover 10 from the body of water, the swim spa cover 10 is rolled from one end to the other. When rolling a typical swim spa cover, the weight of the cover and the trapped air within the cover makes the rolling significantly more difficult. As such the air vents 44 of the swim spa cover 10 allow for the air to escape as the swim spa cover 10 is rolled towards an end of the swim spa cover. The escape of the air through the air vents 44 allow for the rolling of the swim spa cover 10 to happened with ease.

The third waterproof top layer 20 also includes a series of attachments zones 46. The attachments zones 46 are positioned such that there are no more than three support rods 16 between them. This positioning insures the correct tension across the swim spa cover 10 so that water does not pool on the top surface of the swim spa cover 10 and debris will roll off the swim spa cover 10. The attachments zones 46 may be further defined as adjustable straps that may be used to secure the swim spa cover 10 over the body of water. More specifically the attachments straps include seatbelt designed stitching to ensure that they are firmly attached to the swim spa cover 10. Additional safety straps 70 may be positioned at the ends of the swim spa cover 10 and the underside of the swim spa cover 10 so as to provide additional security by ratcheting the swim spa cover 10 in place during high winds. Finally all seams of the third waterproof top layer 20 are stitched facing in a downward direction to ensure that rain and moisture do not get caught with in the seam. The swim spa cover 10 provides an overall lighter construction, namely 30 to 40% lighter which aids in managing the swim spa cover 10 when the user is rolling and unrolling the swim spa cover 10.

As can be seen therefore, the examples described above and illustrated are intended to be exemplary only. Other variations and modifications of the invention are possible. All such modifications or variations are believed to be within the sphere and scope of the invention as defined by the claims appended hereto.

What is claimed is:

1. A swim spa cover positioned over a body of water comprising:

a) a first bottom protection layer positioned over the body of water, the first bottom protection layer having a first radiant barrier;

b) a series of support rods adapted to engage across the first bottom protection layer;

c) a second rounded support layer positioned on top of the support rods; and, d) a third waterproof top layer adapted to engage across the second rounded support layer, wherein a first air gap is created between the body of water and first bottom protection layer, a second air gap created between the series of support rods, the first bottom protection layer and the second rounded support layer, and a third air gap is created within the second rounded support layer; and, wherein the second rounded support layer further comprises a series of rounded supports positioned in between at least two second radiant barriers.

2. The swim spa cover of claim 1 wherein the second radiant barriers are thermal foam layer positioned between aluminum foil reflective material.

3. The swim spa cover of claim 2 wherein the third air gap is created between the at least two second radiant barriers separated by the rounded supports.

4. The swim spa cover of claim 3 wherein the series of rounded supports are foam.

5. The swim spa cover of claim 1 wherein the first radiant barrier of the first bottom protection layer is positioned between two foam substrates.

6. The swim spa cover of claim 5 wherein the first radiant barrier is aluminum foil reflective material.

7. The swim spa cover of claim 1 wherein the third waterproof top layer extends beyond the second rounded support layer creating a waterproof overhang portion.

8. The swim spa cover of claim 7 wherein the third waterproof top layer further comprises a series of air vents positioned on the waterproof overhang portion.

9. The swim spa cover of claim 8 wherein the third waterproof top layer further comprises a series of attachment zones.

* * * * *